US006561376B2

(12) United States Patent
Price et al.

(10) Patent No.: US 6,561,376 B2
(45) Date of Patent: May 13, 2003

(54) BEVERAGE CONTAINER

(75) Inventors: Eric Justin Price, Medford, MA (US); Glen Nielsen, Kent, CT (US); David Kaiser, North Haven, CT (US)

(73) Assignee: Punch Products USA, Inc., Rahway, NJ (US)

( * ) Notice: Subject to any disclaimer, the term of this patent is extended or adjusted under 35 U.S.C. 154(b) by 0 days.

(21) Appl. No.: 09/911,523

(22) Filed: Jul. 24, 2001

(65) Prior Publication Data

US 2002/0027137 A1 Mar. 7, 2002

Related U.S. Application Data

(63) Continuation-in-part of application No. 09/558,784, filed on Apr. 26, 2000, which is a continuation-in-part of application No. 29/117,842, filed on Jan. 31, 2000, now Pat. No. Des. 446,684, and a continuation-in-part of application No. 29/117,841, filed on Jan. 31, 2000, now Pat. No. Des. 446,997.

(51) Int. Cl.[7] ..... B65D 1/44

(52) U.S. Cl. ..... 220/669; 220/662; 220/711; 220/713

(58) Field of Search ..... 220/671, 703, 220/711, 713, 714, 770, 662, 665, 592.17, 906, 718, 669; 229/404; 215/43, 45, 230, 321

(56) References Cited

U.S. PATENT DOCUMENTS

| | | | | | |
|---|---|---|---|---|---|
| 2,792,696 | A | | 5/1957 | Stayart | |
| 2,899,098 | A | * | 8/1959 | Gits | 215/12.1 |
| 3,181,746 | A | * | 5/1965 | Tupper | 215/384 |
| 3,443,715 | A | * | 5/1969 | Edwards | 206/499 |
| 3,563,408 | A | * | 2/1971 | Bijvoet | 220/671 |
| D264,795 | S | | 6/1982 | Strieber | |
| 4,762,229 | A | | 8/1988 | Wickre | |
| 4,986,437 | A | * | 1/1991 | Farmer | 220/713 |
| 5,040,317 | A | * | 8/1991 | Kadjevich | 215/13.1 |
| 5,249,703 | A | | 10/1993 | Karp | |
| 5,301,830 | A | | 4/1994 | Müller | |
| 5,346,095 | A | * | 9/1994 | Deal | 220/660 |
| D370,831 | S | | 6/1996 | Steinfels, III et al. | |
| 5,645,191 | A | | 7/1997 | Neville | |
| D395,395 | S | | 6/1998 | De Muschamp | |
| 5,803,306 | A | | 9/1998 | Lewis | |
| D399,392 | S | | 10/1998 | Husted | |
| 5,839,599 | A | | 11/1998 | Lin | |
| 5,845,807 | A | | 12/1998 | De Villiers | |
| 5,899,354 | A | | 5/1999 | Garcia | |
| 5,918,761 | A | | 7/1999 | Wissinger | |
| D412,809 | S | | 8/1999 | Toro et al. | |
| 6,079,588 | A | * | 6/2000 | Khafizov | 220/675 |
| D446,684 | S | * | 8/2001 | Rrice | D7/509 |
| D446,997 | S | * | 8/2001 | Price | D7/392.1 |
| D458,806 | S | * | 6/2002 | Price et al. | D7/509 |
| D460,317 | S | * | 7/2002 | Price et al. | D7/392.1 |

* cited by examiner

*Primary Examiner*—Lee Young
*Assistant Examiner*—Joseph C. Merek
(74) *Attorney, Agent, or Firm*—Pennie & Edmonds LLP

(57) ABSTRACT

A beverage container includes a body member and a lid that fits thereon in only a single orientation. One way this is accomplished is by using a lid that has an asymmetric perimeter profile such as a reniform. Another way is by using a projection on the body member that uniquely mates with a receiving area on the lid. A first orientation indicator, such as a groove, may be disposed on the body member to indicate the orientation of the container to the user's hand. A second orientation indicator may be disposed on the lid to help guide a user's lips to a drinking aperture and/or assist in preventing spillage.

In a preferred embodiment, the body member includes a clear outer member and an inner member, wherein an advertising medium may be disposed between the two members for viewing.

1 Claim, 12 Drawing Sheets

BEVERAGE CONTAINER

CROSS REFERENCE TO RELATED APPLICATIONS

This application is a continuation-in-part of U.S. patent application Ser. No. 09/558,784, entitled "Beverage Container," filed Apr. 26, 2000, which is a continuation-in-part of both U.S. Design patent application Ser. No. 29/117,842, entitled "Kidney-Shaped Mug," is now Des. Pat. No. 446,684 and U.S. Design patent application Ser. No. 29/117,841, entitled "Mug Lidis now Des. Pat. No. 446,997, " both filed Jan. 31, 2000.

FIELD OF THE INVENTION

The present invention relates generally to beverage containers having lids, and more particularly, to a reusable beverage container.

BACKGROUND OF THE INVENTION

Drinking mugs and beverage containers have been adapted over the years to facilitate beverage consumption during travel activities, such as riding in an automobile, bus, train, or airplane. For example, commuters often fill such containers with their morning coffee, tea, juice, etc. to consume during their journey to work each day. These containers generally consist of a container member, or body member, and a lid member with a drinking aperture that fits over the container member to minimize spillage during travel. See, e.g., U.S. Pat. No. 5,249,703 to Karp, U.S. Pat. No. 5,918,761 to Wissinger, and U.S. Design Pat. No. 399,392 to Husted.

Prior art cylindrical and frusto-conical beverage containers allow the lid member to be placed on the body member so that the drinking aperture may be oriented in a different position relative to the container member each time the lid is removed and replaced on the container member. Users of such containers must therefore shift their attention away from other activities and look at the container to locate the drinking aperture prior to drinking from the container. In the case of containers having handles, users must take care to correctly orient the lid on the container so that the drinking aperture is in the appropriate position relative to the handle. Even when the lid is properly oriented relative to the handle, users will need to locate the drinking aperture so that they do not spill the beverage as they drink from the container. Since users of such containers may be driving automobiles, any distraction or shift in attention away from the driving activity could be quite dangerous. In addition, while working, reading, and/or conversing in the workplace or on public transportation, users may be inclined to reach for, and take a drink from, a beverage container without looking for the drinking aperture.

Thus, there is a need for a beverage container having a lid member wherein a user can easily locate the drinking aperture without making visual contact with the aperture. In this regard, a beverage container can be provided wherein the lid may only be placed over the body member in a single orientation and includes an indicator on the body member to indicate the orientation of the container to a user's hand. It is also desirable to provide a beverage container with a lid that guides a user's lips to the drinking aperture as the container is brought into contact with the user's lips. Such a container will allow a user to properly orient the container for drinking without the user having to shift his or her attention away from other activities to look at the container lid.

SUMMARY OF THE INVENTION

In one preferred embodiment, the present invention is a beverage container comprising a body member and a lid member, the body member having a base, a side surface, an upper end, and an interior volume formed from the base and side surface. The base has a substantially circular cross-section and the upper end has a substantially reniform cross-section. The lid member includes a drinking aperture and is configured to attach to the body member in only a single orientation. When properly attached, the lid forms a substantially fluid-tight seal with the body member.

A first orientation indicator is disposed on the side surface of the body member to indicate the orientation of the container to a user's hand. The first orientation indicator may comprise an elongated depression in the side surface of the body member extending from or near the upper end of the body member toward the base of the body member. Preferably, the elongated depression is aligned with a point on the circumference of the lid member nearest the drinking aperture when the lid is attached to the body member. In one variation of this embodiment, the elongated depression extends to the upper end of the body member thereby forming a reniform cross-section. A reniform-shaped upper end would ensure that the lid fits on the body member in only a single orientation.

In another variation, the first orientation indicator may comprise at least one tactile projection formed on the side surface of the body member. This projection may be in addition to, or in place of, the elongated depression described above.

The beverage container may further comprise a second orientation indicator which is disposed on the lid member and is configured to assist in guiding a user's lips to the drinking aperture without the user having to look at the container. The second orientation indicator may be a depression in the lid substantially aligned with the elongated depression of the first orientation indicator, if used. This results in the lid having a substantially reniform shape. The lid may further comprise a vertical ridge along at least a portion of the perimeter of the lid rising above the surface where the drinking aperture is located. The second orientation indicator may also include, in place of or in addition to the first depression in the lid, a vertical depression in the vertical ridge that may assist the user in locating the drinking aperture and aid in preventing spillage during drinking.

In a second embodiment, the base of the body member has a substantially circular cross-section, while the upper end of the body member has a substantially elliptical cross-section. To ensure that the lid fits on the body in only a single orientation, the upper end of the body member may include an alignment projection that mates with a receiving area located on the lid member when the lid is attached to the body member.

In another preferred embodiment, the body member includes an inner container member and an outer member, wherein the inner member fits within and is attached to the outer member. A perimeter flange on the inner container member engages and is sealed to a perimeter notch on the outer member. The inner container member is attached to the outer member along the flange-notch interface. Preferably, the outer member is made of a transparent material so that an advertisement medium, such as printed paper or cardboard, may be disposed between the inner container member and the clear outer member for viewing.

The outer member includes a base and a side surface. The inner member has an upper end for attachment to the lid. The base has a substantially circular cross-section and the upper end of the inner member has a substantially reniform cross-section. A reniform-shaped lid member having a drinking aperture is configured to attach to the upper end of the inner member in only a single orientation. The lid member of this embodiment is otherwise similar to the lid member of the embodiments previously discussed. A first orientation indicator, as previously described, may be disposed on the side surface of the outer member, and a second orientation indicator, as previously described, may be disposed on the lid member.

In another embodiment utilizing an outer and inner member, the upper end of the inner member has a substantially elliptical perimeter profile, rather than the reniform profile. The inner member preferably includes an alignment projection that mates with a receiving area located on the lid member to ensure that the lid member can be attached to the inner container member in only a single orientation. Features of other embodiments as described previously, including the first and second orientation indicators, may be utilized.

The beverage container may be formed of plastic (i.e., styrene acrylonitrile, polystyrene, polyethylene, polyvinyl chloride, etc.) or any other suitable material.

BRIEF DESCRIPTION OF THE DRAWINGS

The present invention will be understood and appreciated more fully from the following detailed description, taken in conjunction with the drawings in which.

DETAILED DESCRIPTION OF THE PREFERRED EMBODIMENTS

Figure 1:
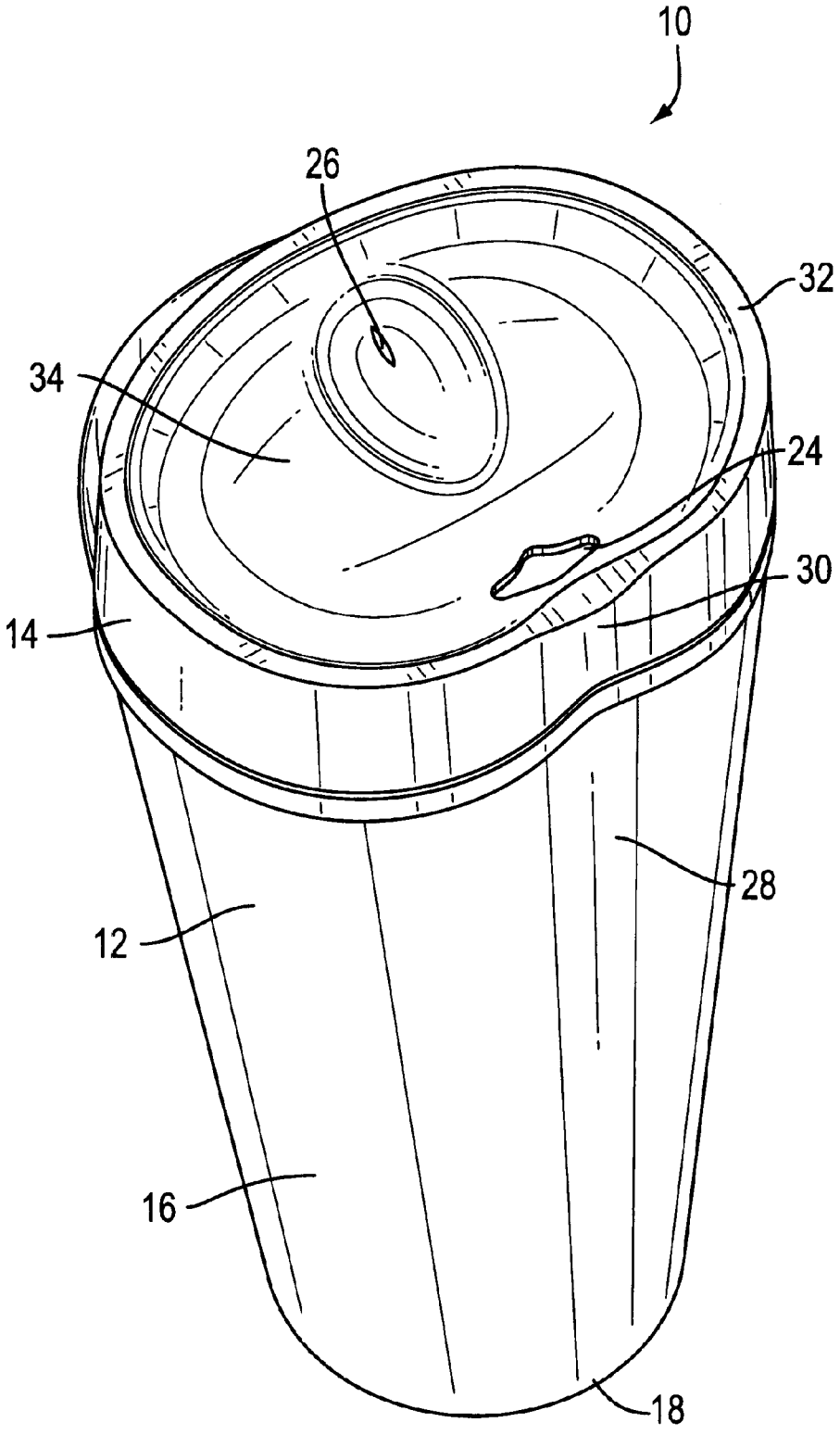
FIG. 1 is an isometric view of a first embodiment of the beverage container of the present invention including a body member and a lid member.

Reference is now made to FIGS. 1–8, which are views of a first embodiment of the present invention. These figures show beverage container 10 comprising a body member 12 and a lid member 14. The body member 12 has a side surface 16, a base 18, an upper end 20, and an interior volume 22. Preferably, the base 18 is substantially circular to facilitate placing the beverage container in beverage holders commonly found in automobiles. The lid member 14 includes a drinking aperture 24 and a vent hole 26. The lid member 14 fits over and preferably forms a fluid-tight seal with a perimeter lip 21 at or near the upper end 20 of body member 12. Vent hole 26 facilitates fluid flow by allowing ambient air to replace withdrawn fluid. An oval or "egg-shaped" concave depression 29 is provided for aesthetic purposes only. Lid 14 and body member 12 are configured so that the lid 14 may only be fitted over the open end 20 of the body member in a single orientation (a "single-orientation fit").

Figure 2:
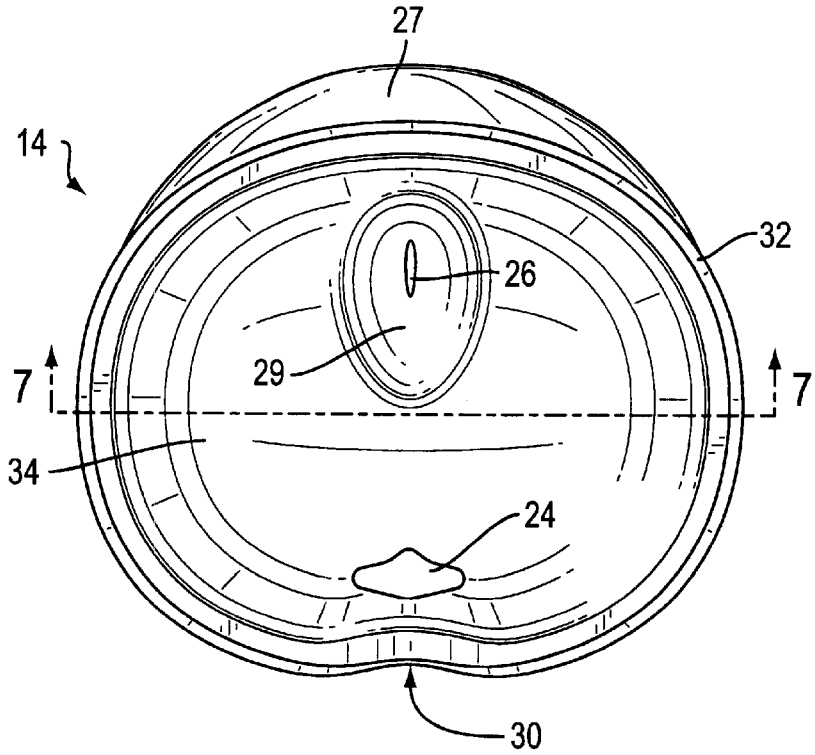
FIG. 2 is a top plan view of the beverage container shown in FIG. 1.
Figure 3:
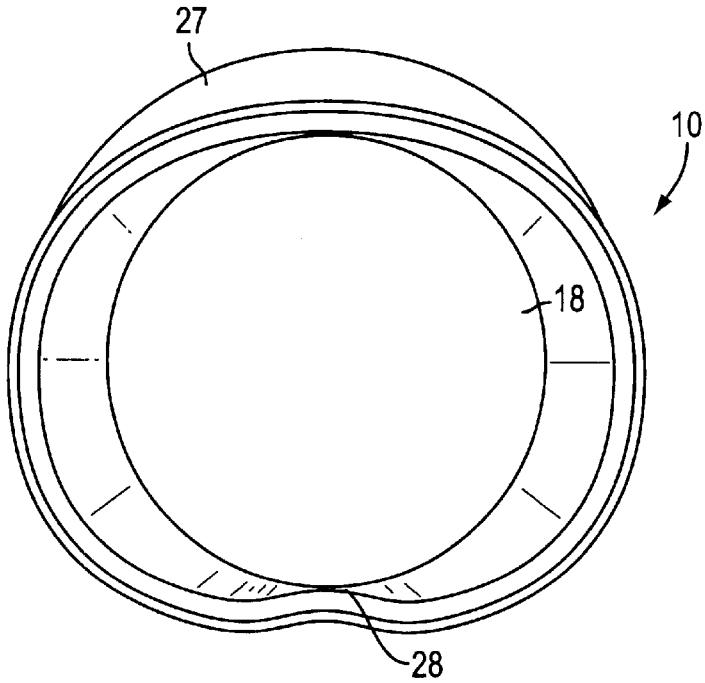
FIG. 3 is a bottom view of the beverage container shown in FIG. 1.

By way of example, the single-orientation fit may be accomplished by forming both the lid 14 and the upper end 20 of the body member in a reniform (i.e., kidney-shaped) configuration. The reniform shape of the lid member is best illustrated in FIG. 2. Since the drinking aperture 24 is fixed relative to the lid, and since the lid only fits on the body member in a single orientation, the drinking aperture is guaranteed to be in the same position each and every time the lid is placed on the body. It should be understood that the shape of the upper end 20 and lid 14 is not limited to a reniform. Rather, any shape can be selected so long as the lid attaches to the body member 12 in only a single orientation. The body member 12 may have any shape that allows for the necessary connection with the lid.

Figure 5:
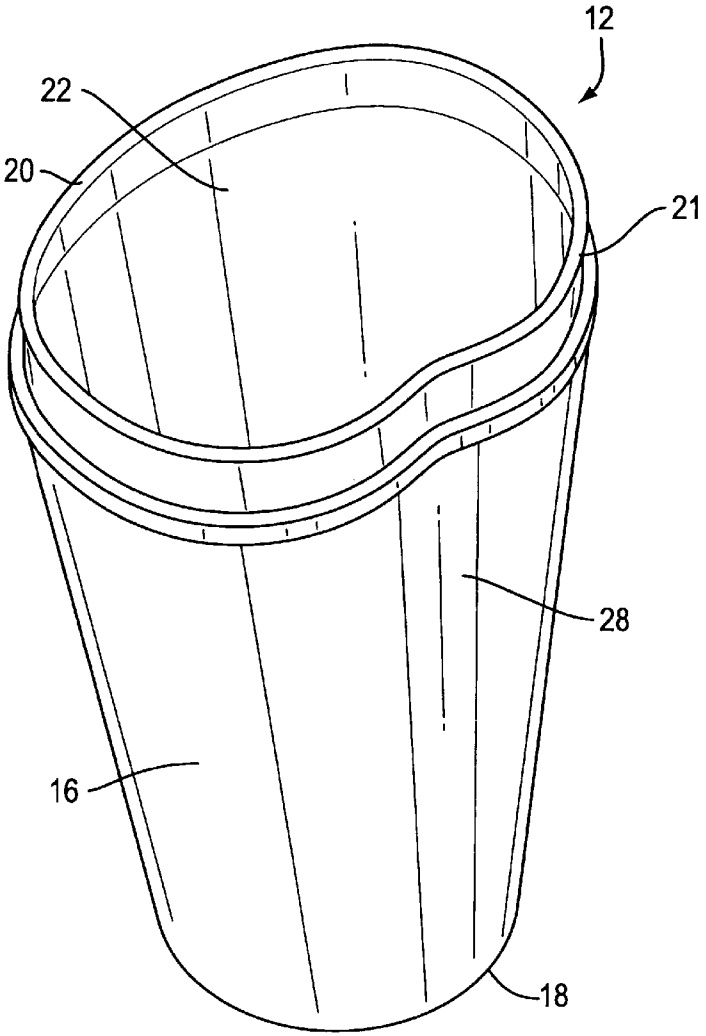
FIG. 5 is an isometric view of the body member of the beverage container shown in FIG. 1.

In order for the user to determine whether the beverage container is being held in the proper orientation without having to look at the container, it is preferred that the body member 12 include a first orientation indicator. The first orientation indicator can be on any portion of the body member that enables a user to confirm that the container is being held in the proper orientation. FIGS. 1 and 5 show the first orientation indicator as an elongated depression 28 disposed on the side surface 16 of the body member 12. The depression 28 extends from or near the upper end 20 of the body member toward the base 18. The depression 28 is shown deepest (most pronounced) at the upper end 20 and gradually tapers, becoming more shallow toward the base 18. The depression 28 may taper completely away before reaching the base 18, which preferably has a circular cross-section. The depression 28 is integral with the upper end 20 of the body member thereby forming the reniform perimeter profile at the upper end of the body member 12. Thus, the depression 28 serves two purposes—it ensures that the lid can only fit on the body in a single orientation, and it forms a part of the first orientation indicator as discussed above.

Figure 9:
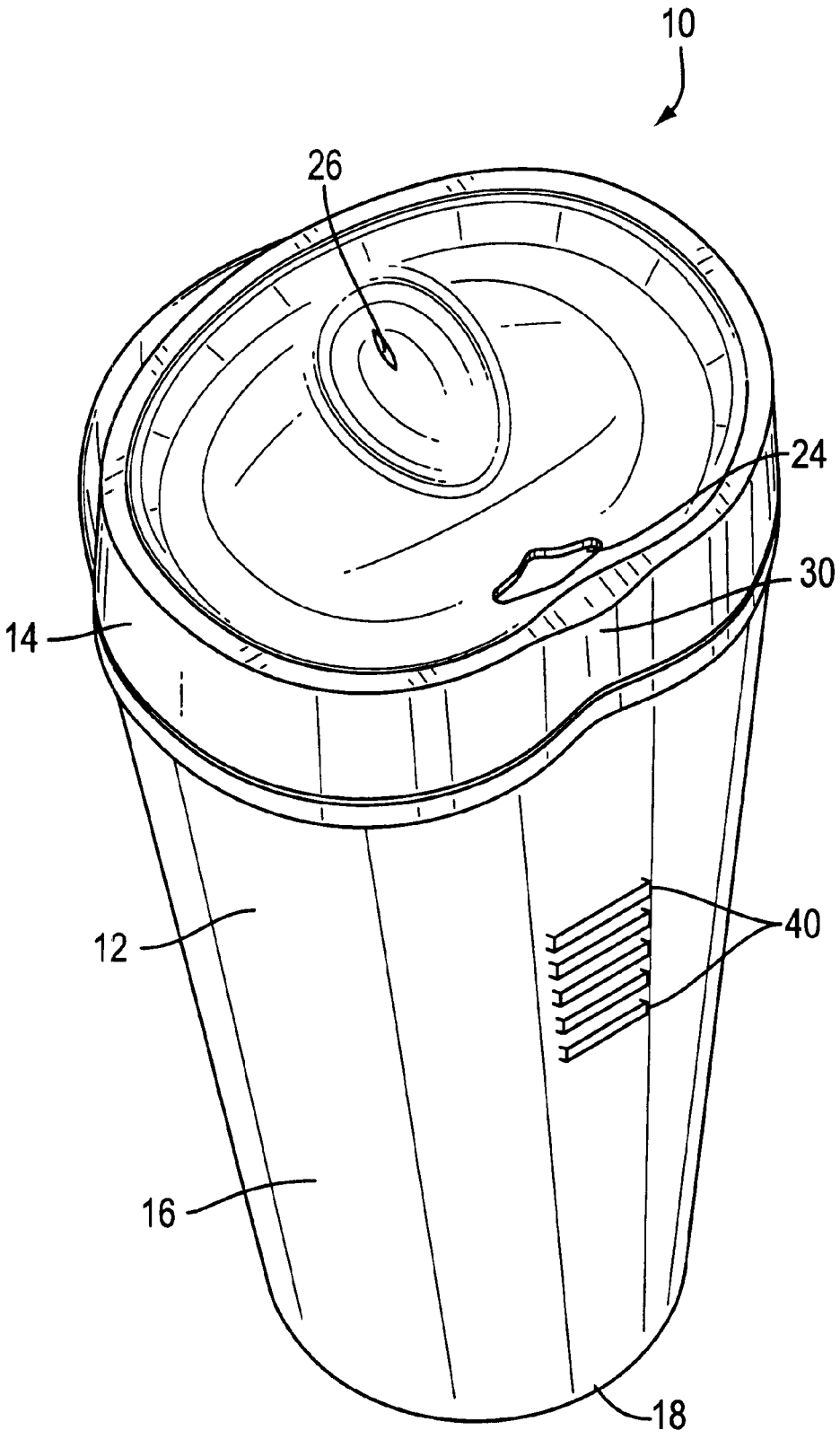
FIG. 9 is an isometric view of a variation of the first embodiment of the present invention showing tactile projections on the front of the body member.

Reference is now made to FIG. 9, which illustrates an additional first orientation indicator. In FIG. 9, the first orientation indicator includes a series of tactile projections 40 on the side surface of the body member 12. These tactile projections 40 are shown as a series of horizontal ribs or ridges, but may take the form of any type of raised surface, such as a raised dot, letter, etc. Moreover, a single tactile projection may also be used rather than a series of projections. Tactile projections 40 may supplement or replace depression 28 in performing the function of indicating the orientation of the container 10 to a user's hand. Preferably, tactile projections 40 are placed in a position on the side surface 16 so that when a user grasps the container, the user's thumb will engage the projections 40 if the container is properly oriented for drinking. If the user's thumb does not engage the projections, the user would know that the container must be re-oriented in the hand for drinking without spillage.

In one variation (not shown), the tactile projection(s) 40 may be formed on the side surface opposite the drinking aperture (i.e., 180 degrees from the location described above and shown in FIG. 9), so that a user's finger(s) engage the projections, rather than the user's thumb. If the user's fingers do not engage the projections, the user knows that the container must be re-oriented so that the user's fingers engage the projections before taking a drink. It should be understood that the projections, as well as any other first orientation indicator, can be located anywhere on the side surface of the body member.

In other variations, the first orientation indicator may comprise a recess, groove, channel, series of dots, or any other suitable indicating structure, such as a handle. U.S. Pat. No. 4,762,229 to Wickre, which discloses a variety of tactile sensing means in the context of a disposable container is hereby incorporated by reference.

Figure 6:
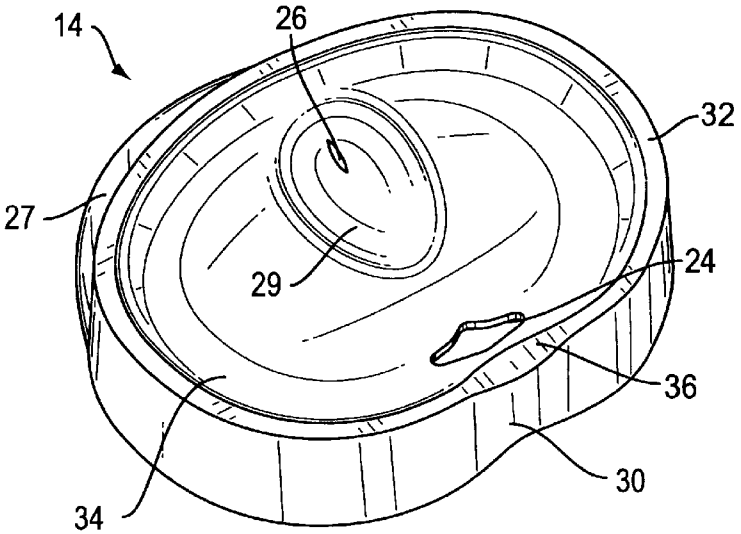
FIG. 6 is an isometric view of the lid member of the beverage container shown in FIG. 1.

Preferably, the beverage container also includes a second orientation indicator. The second orientation indicator may assist in guiding the user's lips to the drinking aperture without the need to look at the beverage container. One embodiment of the second orientation indicator is shown in FIGS. 1, 2 and 6 as a lid depression 30 disposed on lid 14. The second orientation indicator shown in FIG. 1 coincides with the narrowest portion of the reniform profile of the lid 14 and is below the drinking aperture 24 so that it effectively receives a user's lips. When the lid member 14 is placed on the body member 12, the lid depression 30 is preferably aligned with and substantially complements the first depression 28, if used, thereby forming a continuous depression from or near the top of the lid member toward the base 18 of the body member, as shown in FIG. 1. When a user raises the container to his mouth, the lips can sense the lid depression 30, which, at its deepest point, coincides with the center line of the drinking aperture 24. Thus, the user is able to determine that his lips will meet the drinking aperture without the need to look at the lid member.

Figure 4:
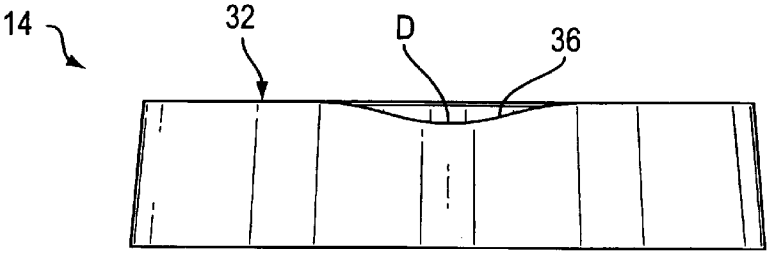
FIG. 4 is a front view of the lid member shown in FIG. 1.

The second orientation indicator need not utilize the lid depression 30 described above. The lid member 14 preferably includes a vertically extending ridge 32 around at least a portion of the perimeter of the lid and forms an uppermost surface along the perimeter of the lid. Below the vertical ridge 32, the lid includes an aperture surface 34 that includes the drinking aperture 24. In lieu of, or in addition to the lid depression 30, the second orientation indicator may comprise a vertical depression 36 in the vertical ridge 32 that can help a user locate the drinking aperture and/or prevent spillage. This is best shown in FIG. 4. The lowest point of the vertical depression 36 (labeled "D" in FIG. 4) preferably coincides with the centerline of the drinking aperture 24.

Figure 7:
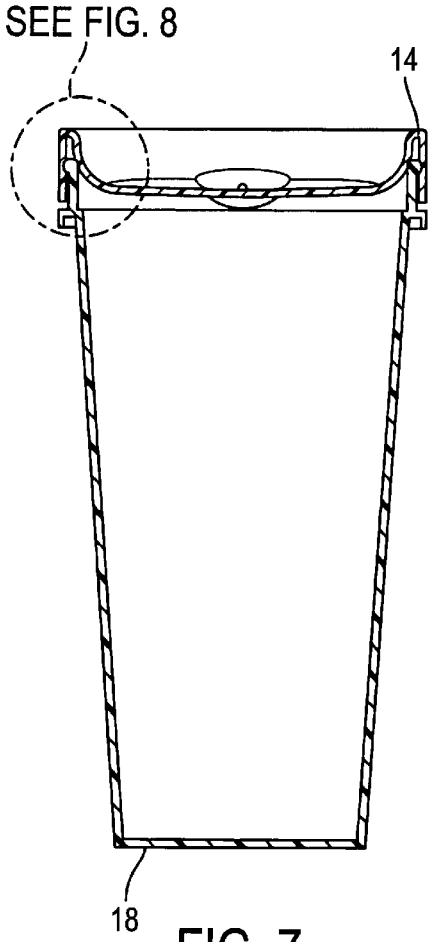
FIG. 7 is a cross-sectional view through the assembled body member and lid member of FIG. 1.
Figure 8:
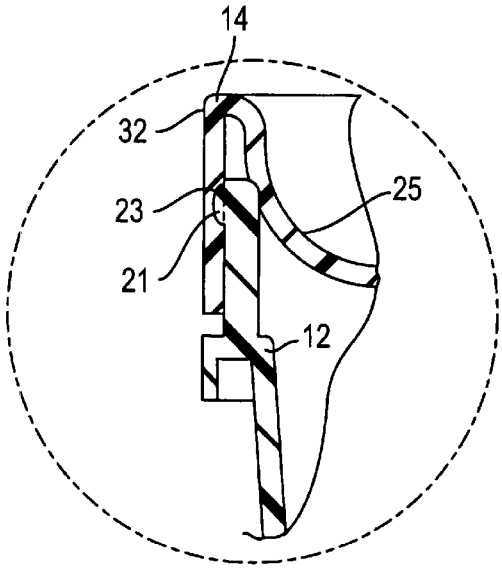
FIG. 8 is a cross-sectional detail showing the attachment of the lid member to the body member of the beverage container shown in FIG. 7.

FIG. 7 is a cross-sectional view through container 10, illustrating how lid member 14 attaches to body member 12. As shown in the detailed view of FIG. 7, a groove 23 on the underside of the lid 14 is aligned with a lip 21 of body member 12 forming an interference or friction fit. The lid includes a biasing surface 25, which urges the lip 21 into the groove 23. The friction fit between lip 21 and groove 23 preferably provides a substantially fluid tight seal to minimize beverage leakage. Preferably, a pull-tab 27 (shown in FIGS. 2 and 6) facilitates removal of the lid 14 from body member 12.

Figure 17:
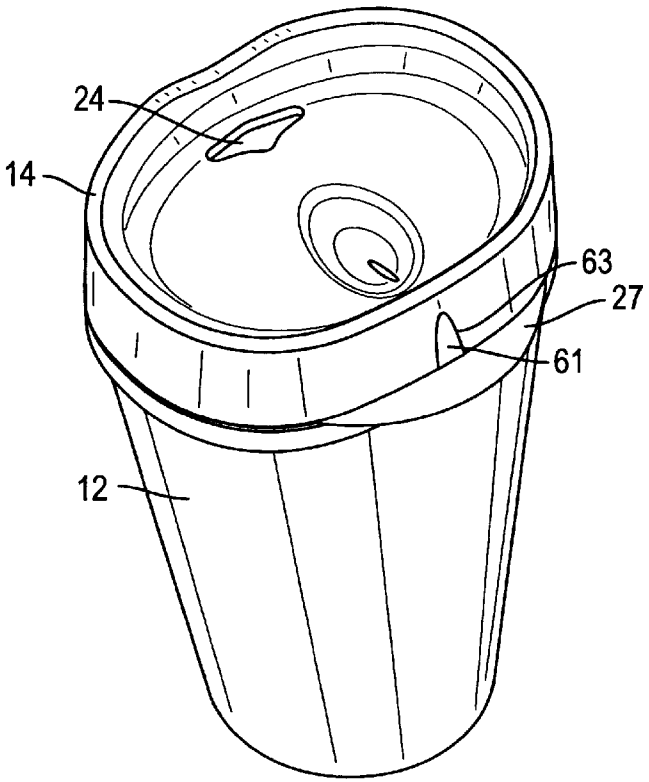
FIG. 17 is an isometric view of the container shown in FIG. 16 in an assembled state with the alignment projection mating with the receiving area.
Figure 16:
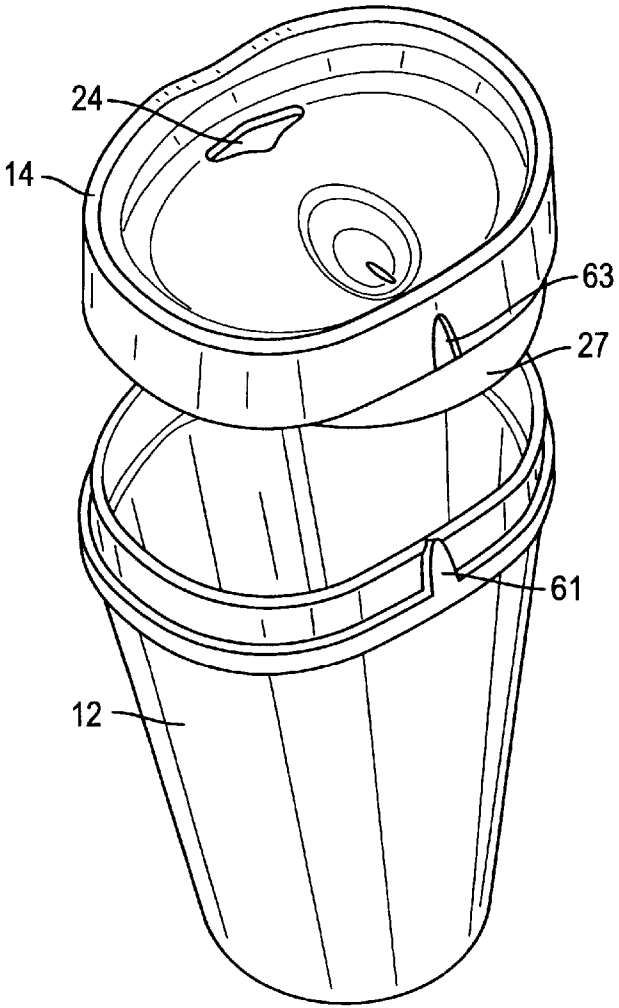
FIG. 16 is an isometric view of the body member and lid member (shown separated) of the container shown in FIG. 10, displaying an alignment projection on the body member and a receiving area on the lid member.

In a second embodiment (shown in FIGS. 10–17), the body member 12 has a circular base 18 and an upper end 20 having a perimeter shaped in a substantially elliptical configuration. Preferably, an alignment projection 61 (shown in FIGS. 16 and 17) on the body member 12 mates with a receiving area 63 formed on the lid member so that the lid only fits on the body member in a single orientation. The alignment projection 61 may take any shape that allows for the proper alignment. Also, the projection-receiving area arrangement 61–63 may assist in providing a fluid tight seal by ensuring proper alignment and fit of the lid to the body member.

Figure 10:
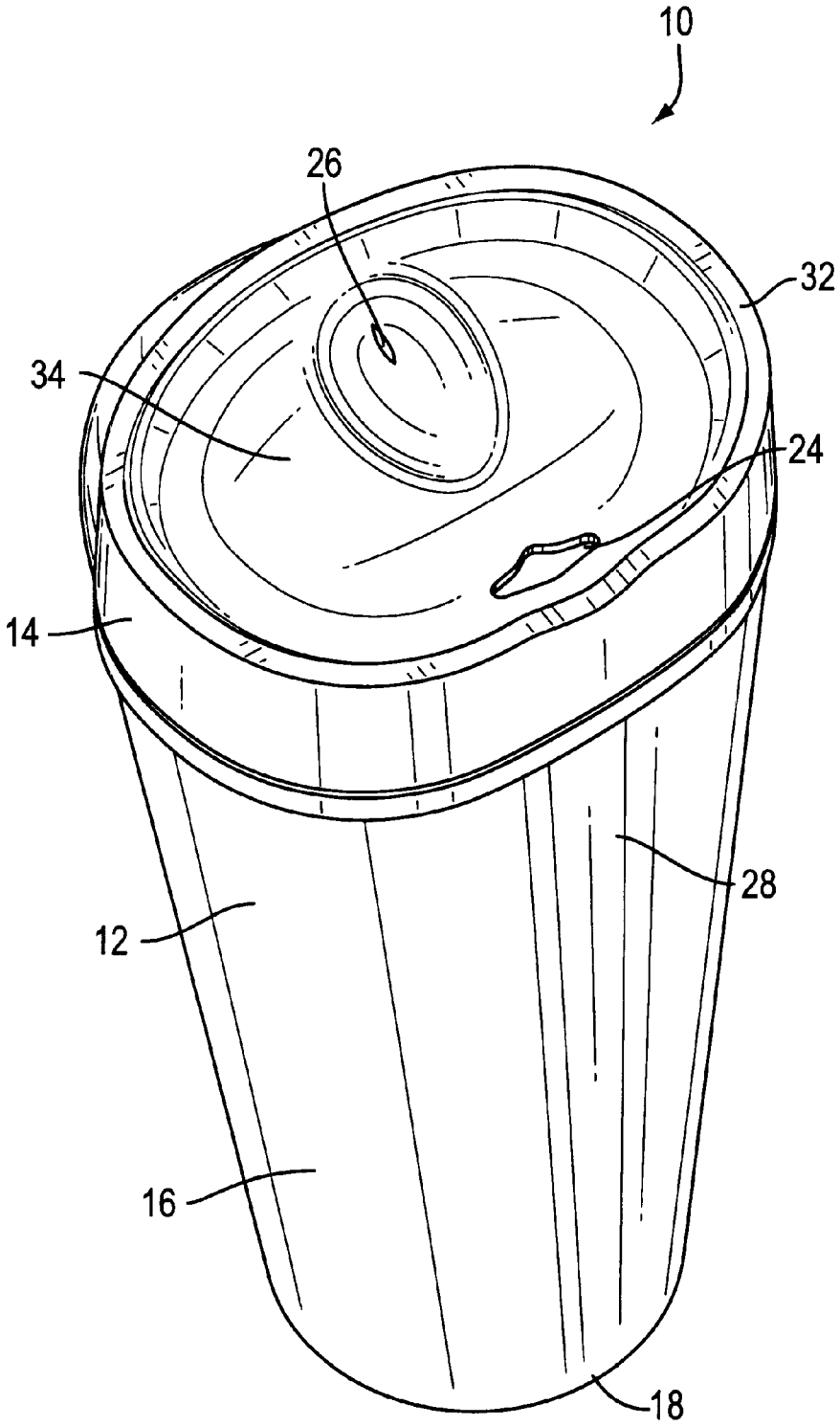
FIG. 10 is an isometric view of a second embodiment of the present invention including a body member and a lid member.
Figure 11:
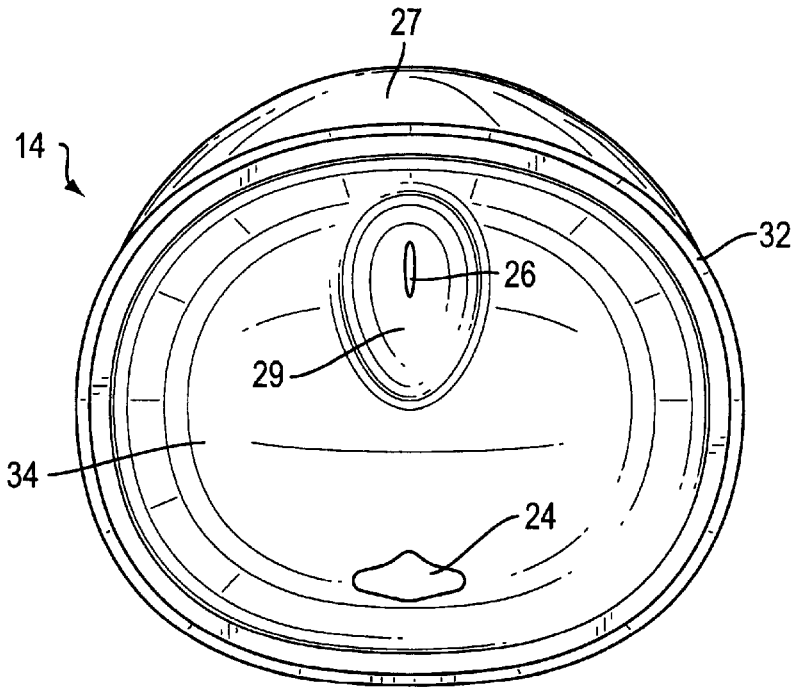
FIG. 11 is a top view of the beverage container shown in FIG. 10.
Figure 12:
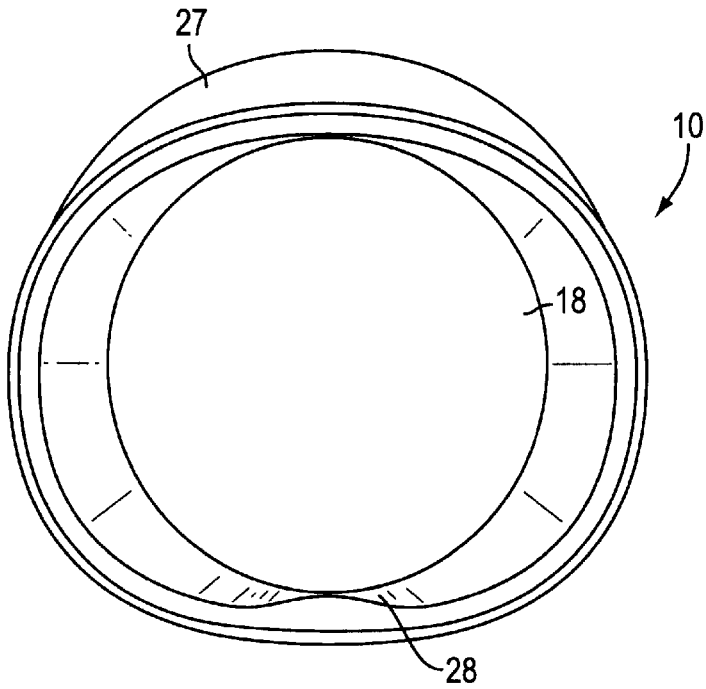
FIG. 12 is a bottom view of the beverage container shown in FIG. 10.
Figure 13:
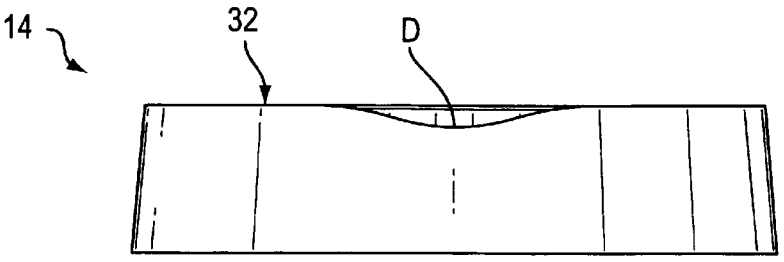
FIG. 13 is a front view of the lid member shown in FIG. 10.
Figure 15:
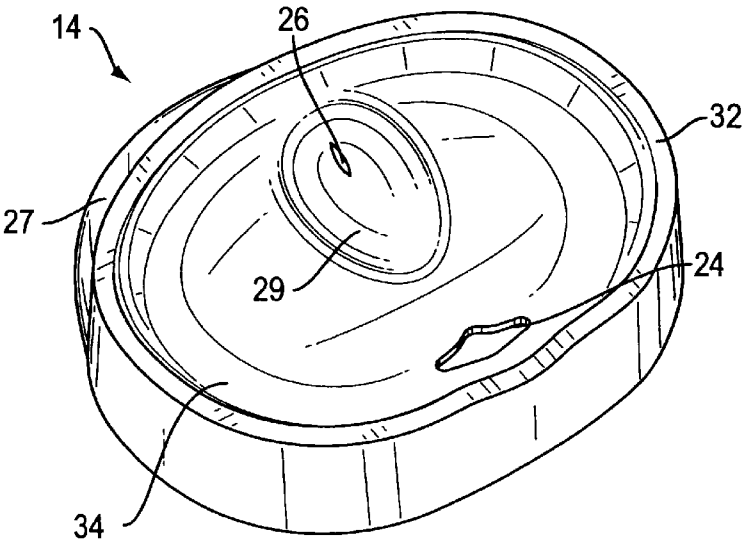
FIG. 15 is an isometric view of the lid member of the container shown in FIG. 10.
Figure 14:
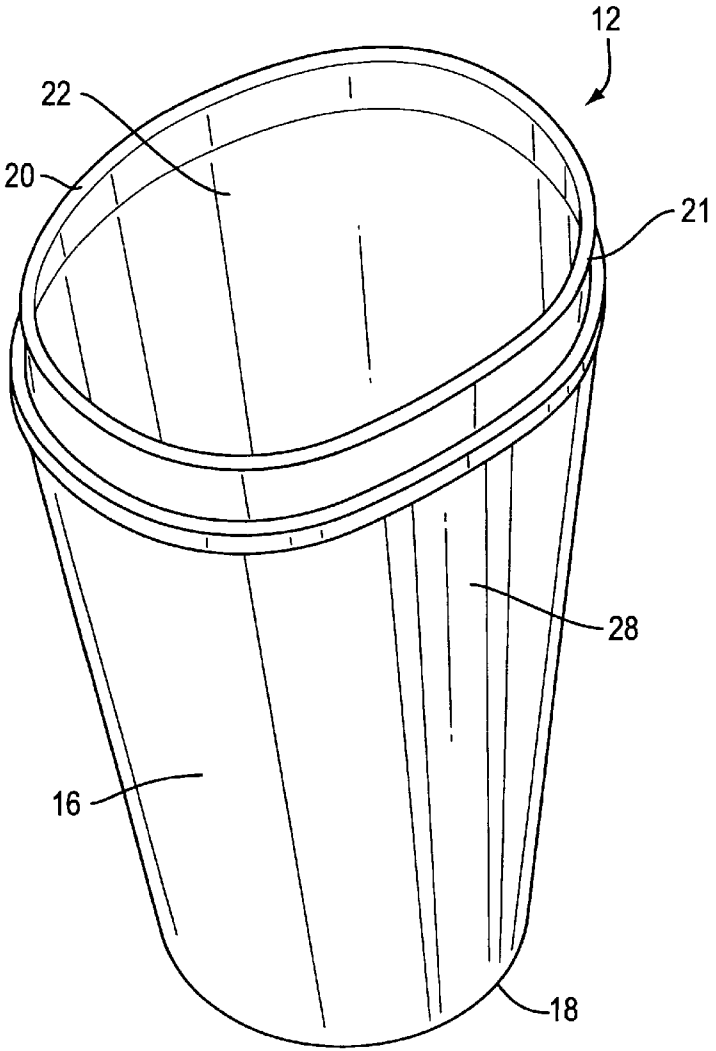
FIG. 14 is an isometric view of the body member of the container shown in FIG. 10.

As shown in FIGS. 10 and 14, elongated depression 28 is recessed into the side surface of the body member 12, similar to the first embodiment but does not extend to the top of the body member 12, nor does it extend into the lid member 14. The elongated depression 28 preferably extends from an area below the lid when the lid is attached to the body member towards the base 18, tapering away before it reaches the base 18 so that the base 18 has a substantially circular perimeter. If this is the case, the upper end 20 of the body member 12 is preferably elliptical as shown in FIG. 14. In either of the first two embodiments, elongated depression 28 is preferably aligned with a point on the circumference of the lid member 14 nearest the drinking aperture 24. A user's thumb would then engage the elongated depression 28 when raising the container to the mouth for drinking. If the user's thumb does not contact the depression 28, the user is aware that he must re-orient the container 10 in the hand prior to taking a drink to avoid spillage. In alternative embodiments not shown, the depression 28 may be on the side surface opposite the drinking aperture, so that a user's finger(s) engage the depression, rather than the user's thumb. Similarly, if the user's fingers do not engage the depression, the user knows that he must re-orient the container so that his fingers do engage the depression before taking a drink. The location and shape of the depression is not limited to the above embodiments. It should be understood that the depression, or other first orientation indicator can be located anywhere on the side surface and may include any of the variations previously discussed with the first embodiment.

The lid member of the second embodiment is substantially similar to that for the first embodiment, with two exceptions. First, as previously described, the lid includes a receiving area 63 for the alignment projection 61 so that the lid fits on the body member only in a single orientation. Other methods for ensuring that the lid only fits on the body member will be understood by those skilled in the art. Second, the shape of the lid is substantially elliptical rather than kidney-shaped as in the first embodiment. Otherwise, the lid members of the first and second embodiments are similar with respect to the various alternatives for the second orientation indicator.

Figure 18:
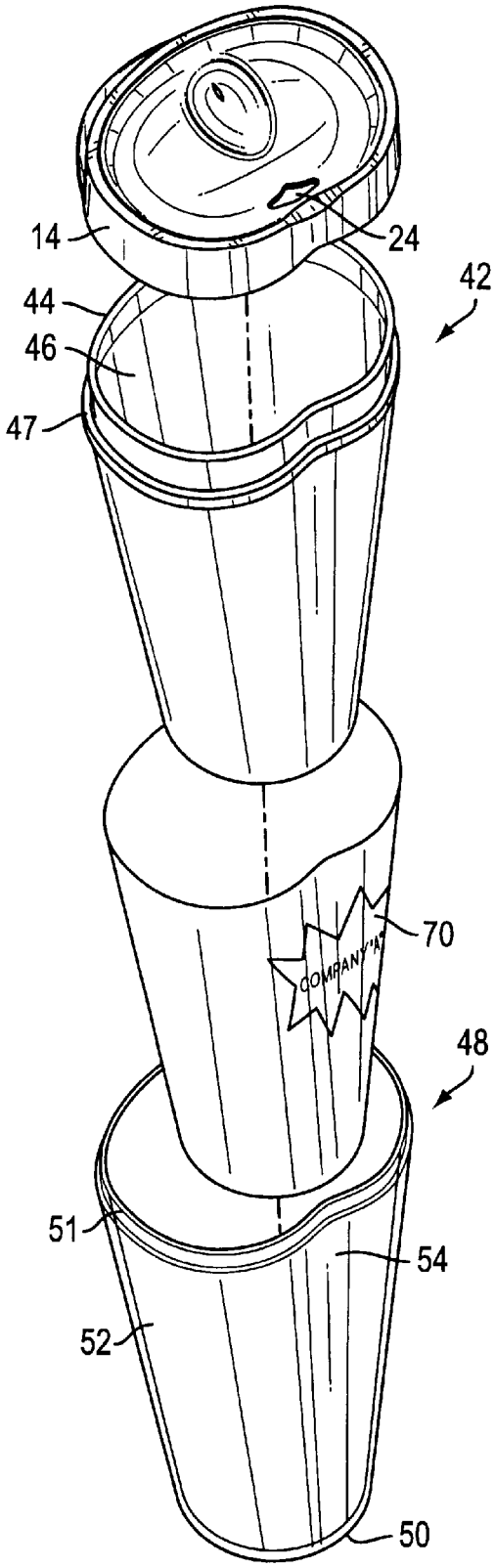
FIG. 18 is an exploded view of a third embodiment of the present invention including a lid member, an inner container member, an advertising medium and an outer member configured to receive the inner member.

Reference is now made to FIG. 18, which shows the components of a third embodiment of the invention. In this embodiment, the container includes an inner member 42 having an upper end 44 and an interior volume 46. The inner member is configured to fit within and be attached to an outer member 48. The outer member 48 is preferably made from a transparent material. Outer member 48 has a base 50 and a side surface 52. The container includes a lid 14 which is configured to fit over the upper end 44 of inner member 42 in a manner similar to that described for the first embodiment, preferably forming a fluid-tight seal between the lid 14 and inner member 42. A first orientation indicator in the form of an elongated depression 54 may be disposed on the side surface 52 of the outer member 48 in a manner similar to the first embodiment. For example, depression 54 may extend from the top of the outer member toward the base 50. The elongated depression 54 is shown deepest at the top of outer member 48 and gradually tapers, becoming more shallow toward the base 50. In the embodiment shown, the depression 54 tapers completely away before reaching the base 50, which has a substantially circular perimeter profile. The depression 54 results in the upper portion of the outer member having a reniform perimeter profile.

The elongated depression 54 is preferably in substantial alignment with the drinking aperture 24, as in the first embodiment. In this configuration, a user's thumb would engage the depression 54 when raising the container to the mouth for drinking. If the user's thumb does not contact the depression, the user is aware that he must re-orient the container in his hand prior to taking a drink. In alternative embodiments not shown, the depression may be on the side surface opposite the drinking aperture (i.e., 180 degrees from the location described above) so that a user's finger(s) engage the depression, rather than the user's thumb. Similarly, if the user's finger(s) do not engage the depression, the user knows that he must re-orient the container so that his fingers engage the depression before taking a drink. In another alternative configuration (not shown), a series of projections, similar to those shown in FIG. 9 may replace or supplement depression 54. Any of the first orientation indicators described for the first embodiment can be used on the outer member of this embodiment.

Figure 20:
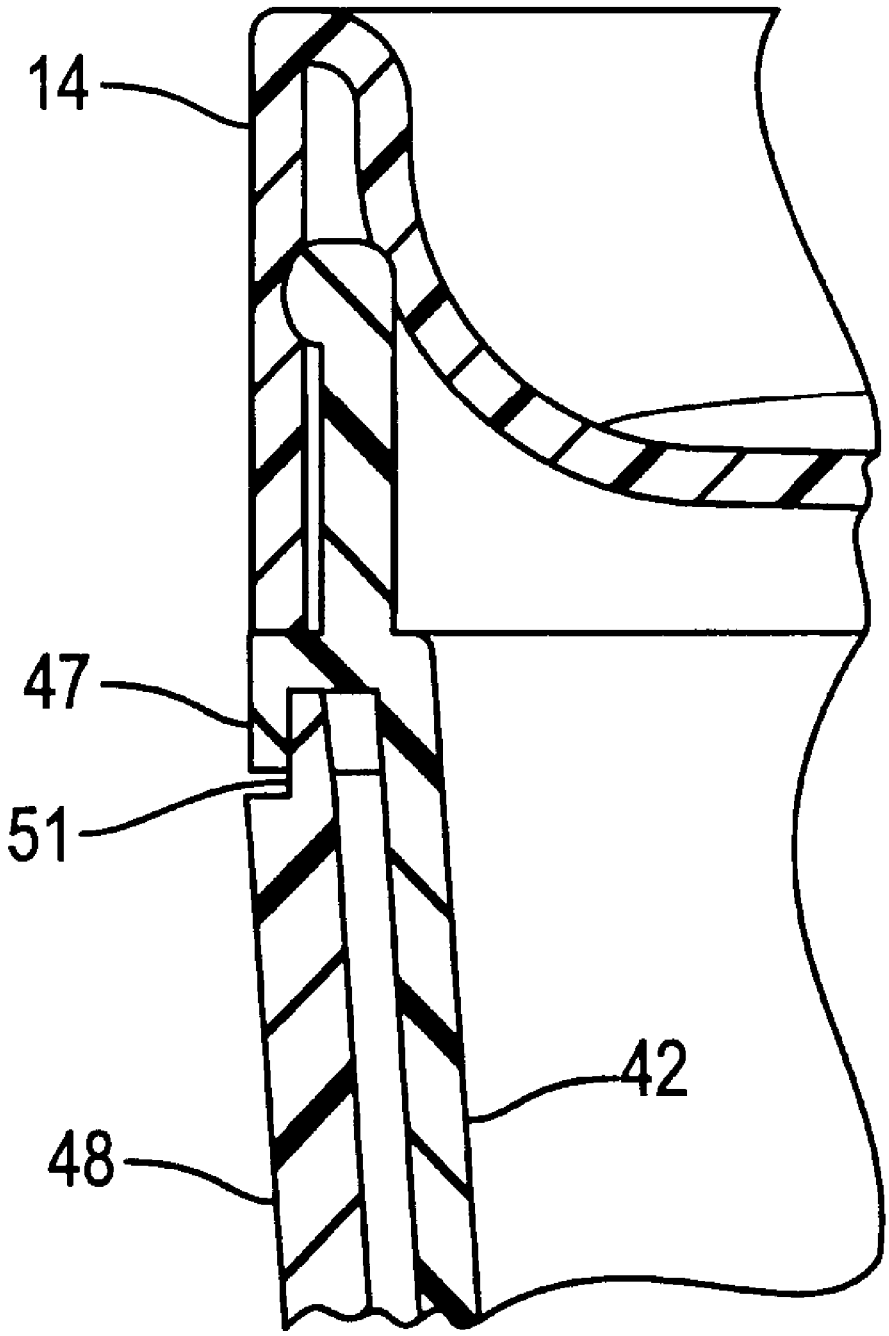
FIG. 20 is a cross-sectional detail of the third and fourth embodiments showing where the inner container member attaches to the outer member.

An advertising medium 70, such as printed paper or cardboard, may be disposed between the inner member 42 and the outer member 48 prior to attaching the two members together. One advantage of this shape is that it allows for an increased surface area for the advertising medium to display graphic material as compared to a container with a cylindrical shape. After insertion of the advertising medium 70, the inner member 42 is placed within and attached to outer member 48. One method of doing this is as follows. A perimeter flange 47 on inner member 42 mates with a perimeter notch 51 of the outer member 48. The inner and outer members 42 and 48 are then attached, preferably by radio-frequency, heat, or electronic sealing along the interface between flange 47 and notch 51. Reference is also made to FIG. 20 showing in more detail the relationship between the inner and outer members when connected. It should be understood that the inner member 42 and outer member 48 can be attached in any manner that holds the two members in a fixed position relative to each other and that preferably allows for the display of the advertising medium if used.

Figure 19:
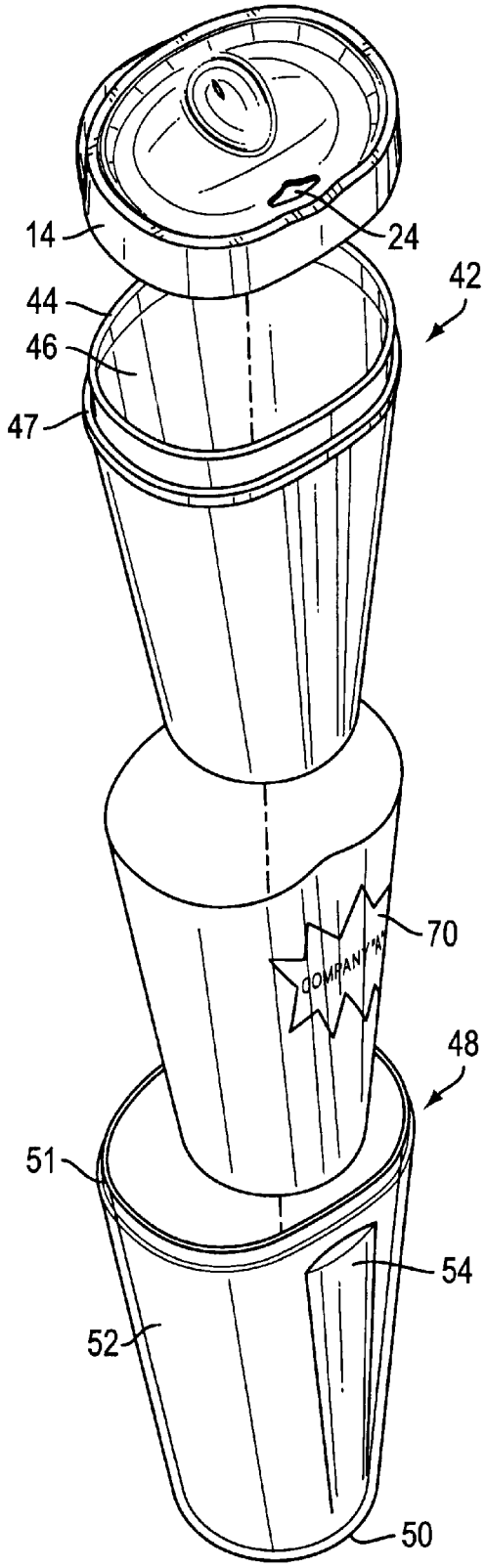
FIG. 19 is an exploded view of a fourth embodiment of the present invention including a lid member, an inner container member, an advertising medium, and a clear outer member configured to receive the inner container member.

While FIG. 18 shows an embodiment of the present invention where the lid 14 and upper end of inner container member 42 have a reniform perimeter profile, one of ordinary skill in the art will recognize that this embodiment may be modified so that the lid and upper end may have an elliptical perimeter profile similar to that shown in FIGS. 10–17 for the second embodiment. This modification merely requires that the depression 54, if used, not extend as far as the very top of the inner member. FIG. 19 shows such an embodiment. The perimeter profile of this embodiment allows for an increased surface area to display graphics on the advertising medium.

In the embodiment shown in FIG. 19, the elongated depression 54 is used as the first orientation indicator. The lid member 14 is configured to attach to the upper end of the inner member in only a single orientation preferably by using an alignment projection and mating receiving area similar to that previously discussed for the second embodiment. The lid attaches to the inner container member the same way as in the previous embodiments utilizing a perimeter lip and groove as in FIGS. 5, 7 and 8. Unlike the embodiment shown in FIG. 18, the second orientation indicator is not a depression in the lid substantially aligned with the elongated depression. Instead, the second orientation indicator is a vertical depression in the vertically extending ridge on the lid, similar to that shown in FIG. 13 for the second embodiment. The embodiment of FIG. 19 may be modified to utilize any of the first orientation indicators previously discussed. In other ways, this embodiment is similar to the third embodiment. For example, as shown in FIG. 20, the inner member 42 is attached to the outer member, preferably by radio frequency, heat, or electronic sealing along the interface between the flange 47 and notch 51.

The body member 12 and lid member 14 are preferably made of a thermoplastic (e.g., styrene acrylonitrile, polystyrene, polyethylene, polyvinyl chloride, etc.), or any other suitable material, and may be manufactured by an injection molding process.

While the present invention has been described with reference to the preferred embodiments, those skilled in the art will recognize that numerous variations and modifications may be made without departing from the scope of the present invention. This is especially true with regard to the specific shape and configuration of the lid, body member, and first and second orientation indicators. For example, it should be understood that the lid member 14 and body member 12 may be configured to threadably engage each other. The lid may screw on the inside of the open end of the body member or on the outside. If the lid is threadably connected to the body member, the connection should include a mechanical stop within the threads to insure that once the lid is screwed fully onto or within the body member, the drinking aperture will be consistently in the same location relative to the body member. The lid 14 may also fit within the open end 20 of the body member 12 in a cork-like manner, rather than snapping around the outside of the upper end of the body member. In this regard, the portion of the lid that would fit within the body member should form a resistance fit with the inside of the body member 12 so that it remains attached. In addition, the beverage container may be formed with a handle attached to the body member. Accordingly, it should be clearly understood that the embodiments of the invention described above are not intended as limitations on the scope of the invention, which is defined only by the following claims.

What is claimed is:

1. A beverage container comprising:

an inner container member having an upper end;

a transparent outer member having a base, a side surface, and an upper end, wherein the inner container member is configured to fit within and be attached to the outer member;

a lid member having a drinking aperture, wherein the lid member is configured to attach to the upper end of the inner container member in only a single orientation;

wherein the outer member includes an elongated depression extending from a point near the top of the outer member towards the base of the outer member, wherein the base has a substantially circular cross-sectional profile, wherein the upper end of the inner container member has a substantially elliptical cross-sectional profile;

wherein the lid further comprises a vertical ridge around at least a portion of the perimeter of the lid adjacent the drinking aperture, wherein the vertical ridge includes a vertical depression in a location nearest the drinking aperture.

* * * * *